United States Patent [19]

Sato et al.

[11] Patent Number: 5,064,610

[45] Date of Patent: Nov. 12, 1991

[54] HEAT RESISTANT STEEL FOR USE AS MATERIAL OF ENGINE VALVE

[75] Inventors: Koji Sato; Rikizo Watanabe, both of Yasugi, Japan

[73] Assignee: Hitachi Metals, Ltd., Tokyo, Japan

[21] Appl. No.: 559,334

[22] Filed: Jul. 30, 1990

[30] Foreign Application Priority Data

Aug. 2, 1989 [JP] Japan ..... 1-200942
Mar. 20, 1990 [JP] Japan ..... 2-071110

[51] Int. Cl.[5] ..... C22C 38/58

[52] U.S. Cl. ..... 420/57; 420/60; 420/37; 420/38; 420/585; 148/327

[58] Field of Search ..... 420/37, 57, 60, 74, 420/584, 585; 148/327

[56] References Cited

U.S. PATENT DOCUMENTS 3,561,953 2/1971 Niimi et al. ..... 420/57
3,826,689 7/1974 Ohta et al. ..... 420/47

FOREIGN PATENT DOCUMENTS 0231492 8/1987 European Pat. Off. .
0296439 12/1988 European Pat. Off. .
91296 4/1968 France ..... 420/57
7208070 3/1972 France .
55-2775 1/1980 Japan .
57-123963 8/1982 Japan ..... 420/38
59-21157 11/1984 Japan .
6389645 10/1986 Japan .
1-79351 3/1989 Japan .
744599 2/1956 United Kingdom .

*Primary Examiner*—Deborah Yee

[57] ABSTRACT

A heat resistant steel for use as a material of engine valves, having a composition containing, not less than 0.01% and below 0.20% of carbon, from 0.05% to 1.0% of silicon, from 7.5% to 15.0% of manganese, from 2.0% to 20.0% in total of at least one of nickel and cobalt, from 15.0% to 25.0% of chromium, not more than 3.0% of molybdenum, above 2.0% and not more than 10.0% of tungsten, not less than 0.01% and below 0.50% of niobium, from 0.30% to 0.65% of nitrogen, not more than 0.02% of boron, and the balance incidental inclusions and iron. Cobalt content is determined to meet the condition of % Co=(Ni±5)%. The heat resistant steel meets the conditions of: oxidation weight loss when held at 1000° C. for 100 hours being not greater than 0.15 mg/cm$^2$/hour in atmosphere; tensile strength being not less than 20 kgf/mm$^2$ at 900° C. after a solution treatment at 1030° to 1070° C. and a subsequent aging treatment; and creep rupture life at 900° C. under stress load of 6 kgf/mm$^2$ being not less than 25 hours.

5 Claims, No Drawings

HEAT RESISTANT STEEL FOR USE AS MATERIAL OF ENGINE VALVE

BACKGROUND OF THE INVENTION

The present invention relates to a heat resistant steel suitable for use as a material of valves on internal combustion engines such as automotive engines.

Hitherto, 21-4N steels (0.55C-0.2Si-9Mn-4Ni-21Cr-0.4N) (by weight percent), known as high manganese heat resistant steels, have been used as materials of exhaust valves of internal combustion engines, because of various advantages such as excellency in high temperature strength, resistance to corrosion by lead and sulfur contained in gasoline and oxidation resistance, as well as low cost. In recent years, however, there is an increasing demand for heat resistant steels for engine valves having greater high-temperature strength than 21-4N steels (containing 21% chromium and 0.4% nitrogen), in view of a current trend for higher efficiency and higher power of gasoline engines which inevitably leads to higher combustion temperature. In order to cope with this demand, various steels have been proposed in, for example, Japanese Unexamined Patent Publication Nos. 55-2775, 60-77964, 59-211557, 63-89645 and 1-79351 (1989).

Those proposed steels, which are intended to improve high-temperature strength of 21-4 N steel, have a greater carbon content, as well as greater content of alloying elements such as vanadium, niobium, molybdenum and tungsten, than 21-4N steel. In order to attain a greater high-temperature strength, it is preferred that these alloying elements are dissolved in the matrix or, alternatively, precipitated in the form of fine carbides to strengthen the structure. In other words, it is not preferred that these alloying elements exist in the form of coarse carbides. In those improved steels, therefore, it is necessary to conduct a solid solution treatment at 1100° C. to 1150° C. which is higher than 1050° C. at which a solution treatment for 21-4N steel is usually conducted, in order to attain the desired high-temperature strength.

Solution treatment in such higher temperature inevitably leads to an increase in the heat consumption causing a damage of the structure of the treating furnace, requiring an improvement in existing treating systems and, hence, a rise in the cost of production of engine valves.

Accordingly, a development of a steel, which can provide a sufficiently large high-temperature strength even by a solution treatment conducted at conventional treating temperature of 1050° C. or so, has been longed for.

It is also to be pointed out that the improved steels mentioned above are rich in elements which adversely affect a property of oxidation resistance, e.g., vanadium and niobium, in order to develop greater high-temperature strength. Consequently, those improved steels exhibit oxidation resistance inferior to that exhibited by 21-4N steel.

More specifically, disadvantages of the known steels proposed for improving 21-4N steel are as follows.

The steel proposed in Japanese Unexamined Patent Publication No. 61-20623 exhibits inferior oxidation resistance to that of 21-4N steel, due to too excessive amounts of vanadium and niobium. The steel proposed in Japanese Unexamined Patent Publication No. 60-77964 also exhibits inferior oxidation resistance to that of 21-4N steel, due to excessive amounts contents of vanadium and niobium. In addition, this steel has a large carbon content so that the strength is impaired due to insufficient solution of coarse primary carbides when it is solution-treated at the same temperature as that for 21-4N steel, though it exhibits an appreciably large high-temperature strength when solution-treatment at a high temperature is conducted.

The steel disclosed in Japanese Unexamined Patent Publication No. 59-211557 also exhibits an unsatisfactorily low level of oxidation resistance due to containment of vanadium as an essential component. Both carbon and nitrogen are contained in this steel for the purpose of forming carbon-nitrides. The disclosure, however, fails to show any definite content of nitrogen. In addition, the carbon content is as high as 0.65% to 0.72% so that the high-temperature strength cannot be improved due to insufficient solid-solution of primary carbides when the solution treatment is conducted at the conventional low temperature.

Steels disclosed in Japanese Unexamined Patent Publication Nos. 63-89645 and 1-79351 (1989) also suffer a disadvantage in that the desired high-temperature strength cannot be obtained when those steels are treated at the conventional low temperatures, due to the large carbon content. Furthermore, molybdenum and tungsten used as the solution-strengthening elements cannot provide satisfactory effects.

SUMMARY OF THE INVENTION

Accordingly, an object of the present invention is to provide a heat resistant steel for use as the material of engine valves which can be solution treated at a temperature which is substantially the same as the temperature conventionally adopted for 21-4N steel and which possesses corrosion resistance and oxidation resistance equivalent to those of 21-4N steel, as well as improved high-temperature strength.

In view of the shortcomings of the known steels mentioned above, the present inventors have attempted to strengthen the steel by solid-solution strengthening of various elements, rather than by the carbide precipitation strengthening which has been conventionally adopted as a method to strengthen heat resistant steels for use as materials of engine valves. As a result, the inventors have discovered that a novel steel having both excellent oxidation resistance and large high-temperature strength can be obtained even with a low solution treatment temperature substantially the same as that (about 1050° C.) conventionally adopted for 21-4N steel, by adopting, while minimizing the carbon content, a strengthening mechanism which makes use of an inter-action of substitution-type solid-solution strengthening elements particularly tungsten which exhibits a lesser tendency of impairment of oxidation resistance and an appreciable effect in improving creep strength together with nitrogen which is an invasion-type solid-solution strengthening element.

One of the critical feature of the steel of the present invention is that it is free of vanadium which would adversely affect the oxidation resistance, in contrast to the known steels for improving 21-4N steel.

According to a first aspect of the present invention, there is provided a heat resistant steel for use as a material of valves on an internal combustion engine, having a composition containing, by weight, not less than 0.01% and below 0.20% of carbon, from 0.05% to 1.0% of silicon, from 7.5% to 15.0% of manganese, from 2.0% to 20.0% in total of at least one of nickel and cobalt, from 15.0% to 25.0% of chromium, not more than 3.0% of molybdenum, above 2.0% and not more than 10.0% of tungsten, not less than 0.01% and below 0.50% of niobium, from 0.30% to 0.65% of nitrogen, not more than 0.02% of boron, and the balance iron and incidental elements.

According to a second aspect of the invention, the cobalt content of the above-mentioned steel is determined to meet the condition of % Co=(Ni±5).

According to a third aspect of the invention, the steel of the first or second aspect mentioned above meets the conditions of: oxidation weight loss when held at 1000° C. for 100 hours in atmosphere being not greater than 0.15 mg/cm$^2$/hour; tensile strength being not less than 20 kgf/mm$^2$ at 900° C. after a solution treatment at 1030° C. to 1070° C. and a subsequent aging treatment; and creep rupture life at 900° C. under stress load of 6 kgf/mm$^2$ being not less than 25 hours.

A description will now be given of the reasons of limiting the contents for the respective elements.

Carbon is quite an effective austenite former which is essential for improving the strength through austenitization of the matrix. In order to obtain an appreciable effect, carbon content should be 0.01% at minimum. An increase in carbon content, however, increases the amount of production of carbides. For example, when carbon content exceeds 0.20%, carbides cannot be satisfactorily dissolved so that alloying elements added to the structure cannot produce any appreciable effect in strengthening the matrix, if the solution treatment is conducted at the comparatively low temperature of about 1050° C. On the other hand, it is desirable to have grain growth to certain sizes for improving creep rupture strength at high temperature. Increase in carbide content undesirably suppresses grain growth, making it difficult to attain higher creep strength.

Addition of an excessively large amount of carbon also causes a reduction in solid solution degree of nitrogen which is one of the major strengthening elements in the steel of the invention.

For these reasons, carbon content is determined to not less than 0.01% and below 0.20%. This low carbon content in the steel of the invention as a heat resistant steel for engine valves is one of the critical features of the present invention.

Silicon effectively serves as a deoxidizer during dissolution an improves oxidation resistance at high temperatures. In order to obtain a good effect, silicon content should be 0.05% at minimum. Addition of silicon in excess of 1.0%, however, adversely affects resistance to corrosion by PbO contained in leaded gasoline and does not produce any effect in improvement in high-temperature strength. For these reasons, silicon content is determined to be from 0.05 to 1.0%.

Manganese is an element which stabilizes austenite in the matrix and which serves as a substitutive element for nickel and cobalt which are expensive. In addition, manganese, when combined with nitrogen, produces a remarkable effect in improving resistance to corrosion by PbO. In order that these advantages are enjoyed, the manganese content should be 7.5% at the smallest. Addition of manganese in excess of 15.0 wt %, however, undesirably causes precipitation of harmful sigma phase due to a multiplied effect produced in combination with chromium. The manganese content is therefore determined to be from 7.5% to 15.0%.

Chromium is an element which is indispensable for improving the corrosion resistance and oxidation resistance of the heat resistant steel for valves and should be contained in amount of 15% at minimum. Chromium content exceeding 25%, however, undesirably promotes precipitation of a sigma phase. Chromium content is therefore determined to be from 15.0 to 25.0%.

Both nickel and cobalt are essential for stabilizing austenite. In order to attain high strength, as well as high resistances to corrosion and oxidation, at least one of nickel and cobalt should be contained in amount which is not smaller than 2.0%.

Addition of nickel and cobalt in excess amounts reduces the degree of solution of nitrogen which is one of the major strengthening elements in the steel of the invention and uneconomically raises the cost of the steel. Therefore, nickel content and/or the cobalt content is determined such that the sum of the nickel and cobalt contents is from 2.0 to 20.0%.

Each of nickel and cobalt alone provides an appreciable effect in the steel of the present invention. The present inventors, however, found that the highest strength can be obtained when both nickel and cobalt are contained at a weight ratio of about 1:1. Preferably, therefore, nickel and cobalt are added in substantially equal amounts within a range of % Co=(Ni±5) %.

Molybdenum is an element which is dissolved as a substitutive atom in the matrix. At the same time, part of molybdenum forms carbides so as to contribute to high-temperature strength. The effect, however, is not so large as that produced by molybdenum which will be mentioned later. The molybdenum content, therefore, is limited to be not greater than 3%.

Tungsten is an element of the same group as molybdenum. As is the case of molybdenum, tungsten is dissolved as a substitutive atom in the matrix, while part of tungsten forms carbides to improve high-temperature strength. Tungsten has an atomic weight which is twice as large that of molybdenum and, hence, exhibits a small rate of diffusion at high temperature, thus producing a remarkable effect in improving creep rupture strength. When tungsten as a substitution type solid-solution strengthening element is added together with nitrogen which is an interstitial solid-solution strengthening element, produces a greater effect in improving high-temperature strength due to an interaction with nitrogen, as compared with the cases where tungsten and nitrogen are added independently.

Thus, tungsten is an element which is essential in the steel of the present invention. When tungsten content is not greater than 2.0%, it is impossible to obtain sufficiently large high-temperature strength. On the other hand, addition of tungsten in excess of 10.0% cannot provide any appreciable effect and undesirably raises specific gravity and cost of the steel. For these reasons, the tungsten content is determined to be above 2.0% and not greater than 10.0%.

Niobium produces stable fine primary carbides so as to prevent coarsening of austenitic grains to provide moderate crystal grain size up to high temperatures, thus offering excellent high-temperature tensile strength and creep rupture strength. In order to attain an appreciable effect, the niobium content should be 0.01% or greater. Addition of niobium in amount of 0.5% or greater, however, seriously degrades oxidation resistance property so that niobium content is determined to be not less than 0.01% and below 0.5%.

Nitrogen is an effective austenite former which compares well with carbon. In the steel of the present invention, however, nitrogen forms almost no alloy with alloying elements such as niobium, molybdenum, tungsten and chromium, in contrast to carbon, but serves as an interstitial solid-solution strengthening element. Therefore, almost all of nitrogen contributes to solid-solution strengthening of the matrix and, therefore, very effectively improves high-temperature strength, even when solution treatment is conducted at the conventional low treating temperature around 1050° C. In order to produce an appreciable effect, nitrogen content should be 0.30% at the smallest. In the composition range of the steel of the invention, the degree of solution of nitrogen is 0.65% at the greatest. Nitrogen content is therefore determined to be from 0.30 to 0.65%.

Boron segregates in grain boundaries when added in a trace amount, so as to improve both creep rupture strength and hot-workability. Such effects are produced when the boron content is 0.02% or less.

The heat-resistant steel for engine valves of the present invention is an iron-based alloy containing the above-mentioned major elements, occasional inclusions mentioned below, and the balance of iron.

$P \leqq 0.04\%$, $V \leqq 0.1\%$, $Ca \leqq 0.02\%$, $S \leqq 0.03\%$, $Ta \leqq 0.1\%$, $Cu \leqq 0.30\%$, $Mg \leqq 0.02\%$ A description will now be given of the reasons of numerical limitations of condition posed in the third aspect of the present invention.

According to the invention, the steel having the described composition is subjected to an ingot-making step after melt refining, and is shaped into desired form through forging or rolling. The steel is then subjected to solution treatment which is conducted by heating for 15 to 60 minutes at a temperature ranging between 1030° C. and 1070° C. which is a standard solid-solution treating temperature for 21-4N steel. The treated steel is quenched and then reheated to about 750° C. and maintained at this temperature for about 1 to 4 hours for the purpose of aging treatment.

The heat resistant steel of the invention for engine valves, which is produced by the above-described process, preferably satisfy the following conditions simultaneously, in order that the steel exhibit resistances to oxidation and corrosion equivalent to those of 21-4N steel and high-temperature strength which is the same or greater than that of the steel disclosed in Japanese Unexamined Patent Publication No. 55-2775. Namely, the steel of the present invention should exhibit an oxidation weight loss of 0.15 mg/cm$^2$/hour when held at 1000° C. for 100 hours in atmosphere. The steel after aging treatment subsequent to solution treatment at 1030° C. to 1070° C. should exhibit a tensile strength of 20 kgf/mm$^2$ or greater at 900° C. or a creep rupture time of 25 hours or longer under a stress load of 6 kgf/mm$^2$ at 900° C. When at least one of these conditions is not met, the steel cannot be satisfactorily used as a material of engine valves. Therefore, the oxidation weight loss, tensile strength and creep rupture time mentioned above are determined to be not greater than 0.15 mg/cm$^2$/hour, not smaller than 20 kgf/mm$^2$ and not shorter than 25 hours, respectively.

EXAMPLES

Steels of the invention, comparison steels and conventional steels were melted in an atmospheric induction furnace and then cast into ingots of 10 kg weight which were then forged at 1100° C. into bars of a square cross-section having a side length of 30 mm. The sample bars were solid-solution treated, at 1050° C. for 30 minutes, and then aged 4 hours at 750° C. followed by air cooling. The bars were then worked into test pieces of a predetermined shape and tested. Compositions of the tested samples and the results of the test are shown in Tables 1 and 2, respectively. Sample Nos. 1 to 5 and 31 to 37 are steels of the present invention, Sample Nos. 11, 12 and 41 are comparative steels and Sample Nos. 21 and 22 are conventional steels. More specifically, Sample No. 21 is a 21-4N steel, while Sample No. 22 is a high-Mn heat resistant steel disclosed in Japanese Unexamined Patent Publication No. 55-2775 which has a creep rupture strength greater than that of 21-4N steel.

All the samples of the steel of the present invention are superior in high-temperature strength and resistances to corrosion and oxidation. Sample Nos. 1 to 5 contained carbon in amounts around 0.15%, while sample Nos. 31 to 37 contained carbon in amounts around 0.05%. A comparison of Sample Nos. 1 to 5 proves that Sample No. 2 containing both nickel and cobalt in amount of 3% each exhibits greater proof stress and tensile strength at 900° C. than Sample Nos. 1 and 5 which contain only one of nickel and cobalt in amount of 6%. This shows that a greater effect is produced when nickel and cobalt are added simultaneously than when only one of them is added. On the other hand, Sample No. 33 which contains 9% nickel and 6% cobalt exhibits greater proof stress and tensile strength than Sample No. 35 containing 12% nickel and 3% cobalt. This means that a greater high-temperature strength is obtainable when the ratio between nickel and cobalt approaches 1.0 when both nickel and cobalt are contained. It is thus understood that a greater strength can be obtained when the condition of $\% Co = (Ni \pm 5) \%$ is met.

It is also understood that the high-temperature strength decreases as the nitrogen content is reduced as in Sample No. 3. This suggests that nitrogen plays an important role in the steel of the present invention. Sample Nos. 31 and 32 have the same nickel content as Sample No. 3. In these alloy steels, however, the reduction in the strength due to decrease in the nitrogen content is minimized by a decrease in the carbon content and an increase in the tungsten equivalent.

Sample No. 12 which is a comparative steel has an molybdenum content of 2.45% which is greater than the molybdenum equivalents in Sample Nos. 1 to 5 of the present invention expressed by $(Mo + \frac{1}{2}W) = 2.2$. Sample No. 12 exhibits a large tensile strength at 900° C. but the creep rupture strength at 900° C. is inferior to that exhibited by the steel of the invention. The large creep rupture strength exhibited by the steel of the present invention owes to tungsten contained in the steel of the invention. It is understood that molybdenum alone cannot provide excellent characteristics necessary for valve materials to which the present invention pertains. From a comparison between Sample Nos. 31 and 32, it is understood that the creep rupture strength is slightly lowered as a result of substitution of part of tungsten with molybdenum. It is also understood that a greater tungsten content provides a greater creep rupture life, as in the case of Sample No. 36.

Sample No. 11 which is a comparative steel has substantially the same (C+N) content as those in Sample Nos. 1 to 5 which are steels produced in accordance with the invention. In Sample No. 11, however, the carbon content and the nitrogen content are respectively greater and smaller than those in Sample Nos. 1 to 5. Sample No. 11 has many coarse carbides of tungsten, molybdenum and chromium which cannot be dissolved sufficiently by solution treatment conducted at a temperature around 1050° C. In Sample No. 11, therefore, tungsten, molybdenum and chromium cannot contribute to enough strengthening of the matrix. These coarse carbides also restrain growth of crystal grains. In Sample No. 11, therefore, the creep rupture life is about half or less that of the steel of Sample Nos. 1 to 5 prepared in accordance with the invention. Furthermore, Sample No. 11 exhibits a slight increase in the corrosion weight loss due to corrosion by PbO, because of small nitrogen content.

Sample No. 41 as a comparison steel has a composition similar to that of Sample No. 2 of the invention but has an niobium content increased as compared with that in Sample No. 2. Sample No. 41 therefore exhibits much inferior corrosion resistance as compared with the steel of the invention although it exhibits superior high-temperature strength. It is therefore understood that the addition of an excessive amount of niobium adversely affects the corrosion resistance of steels.

It will be seen also that the Samples of steel of the invention exhibits remarkable improvement in proof stress, tensile strength and creep rupture strength at 900° C. as compared with Sample No. 21 which is a conventional 21-4N steel.

Another conventional steel which is shown as Sample No. 22 exhibits a 900° C. creep rupture strength which is below half that of the steel of the present invention when the solution treatment temperature is 1050° C. Thus, the merits of the steel of Sample No. 22 cannot be fully enjoyed when such a low solution treatment temperature is adopted. Furthermore, Sample No. 22 contains, for the purpose of improving high-temperature strength, elements such as vanadium and niobium which adversely affect the oxidation resistance. Consequently, this sample exhibits much inferior oxidation resistance to those of other steels.

As will be apparent from the above, according to the present invention, it is possible to obtain a steel having a greater high-temperature strength than conventional 21-4N steel even when solution treatment is conducted at the same temperature as that adopted in the treatment of the conventional 21-4N steel. In addition, the steel of the invention exhibits corrosion and oxidation resistances greater than those exhibited by existing steels having improved high-temperature strength and equivalent to those of 21-4N steel. Therefore, valves for automotive engines, produced from the steel of the invention, can sustain a higher operation temperature than valves made from known steels, thus making it possible to design and produce engines having higher output power and efficiency.

TABLE 1

| | Sample Nos. | Chemical Compositions (wt %) | | | | | | | | | | | | | | |
|---|---|---|---|---|---|---|---|---|---|---|---|---|---|---|---|---|
| | | C | Si | Mn | P | S | Ni | Cr | W | Mo | V | Co | N | Nb | B | Fe |
| Steel of The Present Invention | 1 | 0.16 | 0.21 | 9.37 | 0.013 | 0.012 | 5.95 | 20.6 | 3.36 | 0.50 | — | — | 0.48 | 0.09 | 0.005 | Bal. |
| | 2 | 0.16 | 0.12 | 9.46 | 0.012 | 0.011 | 2.97 | 20.4 | 3.37 | 0.50 | — | 3.03 | 0.50 | 0.09 | 0.005 | " |
| | 3 | 0.16 | 0.20 | 9.48 | 0.014 | 0.011 | 2.99 | 20.5 | 3.51 | 0.53 | — | 2.01 | 0.40 | 0.08 | 0.005 | " |
| | 4 | 0.16 | 0.21 | 9.54 | 0.013 | 0.011 | 2.97 | 22.4 | 3.50 | 0.53 | — | 2.92 | 0.47 | 0.08 | 0.004 | " |
| | 5 | 0.13 | 0.22 | 9.67 | 0.014 | 0.013 | — | 20.0 | 3.43 | 0.49 | — | 6.0 | 0.50 | 0.09 | 0.005 | " |
| Comparative Steel | 11 | 0.41 | 0.21 | 9.56 | 0.012 | 0.014 | 3.11 | 20.5 | 3.42 | 0.46 | — | 2.96 | 0.25 | 0.07 | 0.005 | " |
| | 12 | 0.15 | 0.18 | 9.48 | 0.013 | 0.010 | 2.90 | 20.8 | — | 2.45 | — | 2.92 | 0.47 | 0.10 | 0.004 | " |
| Conventional Steel | 21 | 0.55 | 0.16 | 9.28 | 0.025 | 0.001 | 4.02 | 21.6 | — | — | — | — | 0.41 | — | — | " |
| | 22 | 0.35 | 0.19 | 8.28 | 0.022 | 0.013 | 6.04 | 21.9 | — | 2.56 | 0.18 | — | 0.44 | 0.31 | 0.004 | " |
| Steel of The Present Invention | 31 | 0.05 | 0.13 | 9.28 | 0.007 | 0.007 | 2.96 | 20.3 | 6.06 | — | — | 2.98 | 0.39 | 0.08 | 0.004 | " |
| | 32 | 0.05 | 0.13 | 9.26 | 0.007 | 0.008 | 5.94 | 20.4 | 4.07 | 1.01 | — | 2.94 | 0.41 | 0.08 | 0.005 | " |
| | 33 | 0.05 | 0.19 | 9.62 | 0.009 | 0.005 | 9.01 | 21.1 | 6.00 | — | — | 6.06 | 0.48 | 0.08 | 0.005 | " |
| | 34 | 0.05 | 0.20 | 9.53 | 0.008 | 0.006 | 8.90 | 21.0 | 5.85 | — | — | 2.96 | 0.51 | 0.08 | 0.005 | " |
| | 35 | 0.06 | 0.19 | 9.51 | 0.003 | 0.006 | 11.99 | 20.9 | 5.86 | — | — | 2.84 | 0.50 | 0.07 | 0.004 | " |
| | 36 | 0.05 | 0.21 | 9.66 | 0.004 | 0.006 | 11.83 | 20.9 | 8.20 | — | — | 2.97 | 0.52 | 0.08 | 0.006 | " |
| | 37 | 0.05 | 0.22 | 9.62 | 0.002 | 0.005 | 11.79 | 20.5 | 6.02 | — | — | — | 0.55 | 0.08 | 0.005 | " |
| Comparative Steel | 41 | 0.16 | 0.19 | 9.34 | 0.006 | 0.011 | 2.93 | 21.2 | 3.45 | 0.50 | — | 2.97 | 0.55 | 0.97 | 0.005 | " |

TABLE 2

| | Sample No. | Tensile characteristics | | | | | |
|---|---|---|---|---|---|---|---|
| | | Room Temp. | | | 900° C. | | |
| | | 0.2% Proof stress (kfg/mm$^2$) | Tensile strength (kfg/mm$^2$) | Elongation (%) | 0.2% Proof stress (kfg/mm$^2$) | Tensile strength (kfg/mm$^2$) | Elongation (%) |
| Steel of The Present Invention | 1 | 64.4 | 101.6 | 40.0 | 18.3 | 22.1 | 99.0 |
| | 2 | 71.2 | 108.4 | 43.0 | 20.0 | 23.9 | 86.2 |
| | 3 | 65.9 | 103.6 | 40.0 | 16.0 | 20.4 | 98.0 |
| | 4 | 72.7 | 109.6 | 33.9 | 17.2 | 21.0 | 87.5 |
| | 5 | 70.3 | 108.6 | 37.1 | 18.5 | 21.8 | 73.0 |
| Comparative Steel | 11 | 73.2 | 114.4 | 26.6 | 15.5 | 20.4 | 91.0 |
| | 12 | 71.6 | 109.1 | 35.6 | 17.1 | 20.5 | 88.0 |
| Conventional Steel | 21 | 72.4 | 118.1 | 22.8 | 10.9 | 18.3 | 102.0 |
| | 22 | 68.5 | 105.2 | 27.8 | 15.7 | 20.3 | 87.8 |
| Steel of The Present Invention | 31 | 63.1 | 111.4 | 33.7 | 17.3 | 21.7 | 68.0 |
| | 32 | 61.2 | 101.4 | 44.9 | 18.3 | 22.3 | 104.1 |
| | 33 | 70.5 | 108.5 | 38.0 | 20.8 | 25.8 | 89.5 |
| | 34 | 64.8 | 104.7 | 41.1 | 19.4 | 24.0 | 86.5 |
| | 35 | 61.4 | 101.7 | 43.1 | 20.2 | 24.8 | 99.4 |
| | 36 | 73.7 | 114.2 | 29.4 | 18.9 | 24.2 | 73.9 |

TABLE 2-continued

| | | | | | | | |
|---|---|---|---|---|---|---|---|
| | 37 | 65.9 | 105.8 | 39.7 | 19.3 | 24.1 | 90.2 |
| Comparative Steel | 38 | 67.6 | 107.9 | 34.3 | 17.1 | 21.5 | 75.9 |

| | Sample No. | Creep Rupture Characteristics 900° C. - 6 kgf/mm$^2$ Rupture Life (hrs) | Elongation (%) | Corrosion Weight Loss by PbO *900° C. × 1 h in $Al_2O_3$ Crucible (mg/cm$^2$/hrs) | Oxidation Weight Loss [1000° C. × 100 h] (mg/cm$^2$/hrs) |
|---|---|---|---|---|---|
| Steel of The Present Invention | 1 | 40.1 | 62.2 | 175 | 0.08 |
| | 2 | 39.1 | 47.8 | 173 | 0.12 |
| | 3 | 34.9 | 46.5 | 161 | 0.03 |
| | 4 | 30.2 | 57.5 | 154 | 0.05 |
| | 5 | 37.7 | 40.7 | 166 | 0.07 |
| Comparative Steel | 11 | 14.0 | 81.2 | 203 | 0.11 |
| | 12 | 21.5 | 65.0 | 178 | 0.14 |
| Conventional Steel | 21 | 0.7 | 85.0 | 167 | 0.14 |
| | 22 | 13.1 | 78.3 | 159 | 0.39 |
| Steel of The Present Invention | 31 | 42.0 | 41.7 | 166 | 0.06 |
| | 32 | 35.2 | 20.5 | 165 | 0.09 |
| | 33 | 48.5 | 43.0 | 105 | 0.10 |
| | 34 | 45.2 | 31.9 | 166 | 0.10 |
| | 35 | 48.4 | 44.9 | 125 | 0.06 |
| | 36 | 77.2 | 35.0 | 109 | 0.09 |
| | 37 | 55.7 | 55.7 | 188 | 0.05 |
| Comparative Steel | 38 | 48.9 | 56.3 | 204 | 0.74 |

*Data of Nos. 31 to 37 and 41 obtained at 920° C. × 1 h.

What is claimed is:

1. A heat resistant steel for use as a material of engine valves, having a composition containing, by weight, not less than 0.01% and below 0.20% of carbon, from 0.05% to 1.0% of silicon, from 7.5% to 15.0% of manganese, from 2.0% to 20.0% in total of at least one of nickel and cobalt, from 15.0% to 25.0% of chromium, not more than 3.0% of molybdenum, above 2.0% and not more than 10.0% of tungsten, not less than 0.01% and below 0.50% of niobium, from 0.30% to 0.65% of nitrogen, not more than 0.02% of boron, and the balance iron and incidental elements.

2. A heat resistant steel for use as a material for engine valves, having a composition containing, by weight, not less than 0.01% and below 0.20% of carbon, from 0.05% to 1.0% of silicon, from 7.5% to 15.0% of manganese, from 2.0% to 20.0% in total of at least one of nickel and cobalt, from 15.0% to 25.0% of chromium, not more than 3.0% of molybdenum, above 2.0% and not more than 10.0% of tungsten, not less than 0.01% and below 0.50% of niobium, from 0.30% to 0.65% of nitrogen, not more than 0.02% of boron, and the balance iron and incidental elements, wherein the cobalt content is determined to meet the condition of % Co=(Ni±5) %.

3. The heat resistant steel according to claim 1 or claim 2, wherein the heat resistant steel meets the conditions of: oxidation weight loss when held at 1000° C. for 100 hours being not greater than 0.15 mg/cm$^2$/hour in atmosphere; tensile strength being not less than 20 kgf/mm$^2$ at 900° C. after a solution treatment at 1030° C. to 1070° C. and a subsequent aging treatment; and creep rupture life at 900° C. under stress load of 6 kgf/mm$^2$ being not less than 25 hours.

4. An engine valve formed of the alloy of claim 1 or claim 2

5. The heat resistant steel according to claim 1 or claim 2 wherein ≦0.1% V and ≦0.3% Cu are present as incidental elements.

* * * * *